US012442274B2

(12) United States Patent
Molero Garcia et al.

(10) Patent No.: US 12,442,274 B2
(45) Date of Patent: Oct. 14, 2025

(54) WELL PRODUCTION MANAGEMENT IN SOUR ENVIRONMENT AT A SURFACE EQUIPMENT ZONE

(71) Applicant: Schlumberger Technology Corporation, Sugar Land, TX (US)

(72) Inventors: Nestor Jesus Molero Garcia, Dammam (SA); Pierre Ramondenc, Puteaux (FR); Iyad Hamed Naji, Ahmadi (KW); Scott Alexander Douglas Bulloch, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/675,521

(22) Filed: May 28, 2024

(65) Prior Publication Data

US 2024/0392649 A1 Nov. 28, 2024

Related U.S. Application Data

(60) Provisional application No. 63/504,474, filed on May 26, 2023.

(51) Int. Cl.

| | |
|---|---|
| ***E21B 34/02*** | (2006.01) |
| ***E21B 47/06*** | (2012.01) |
| *E21B 19/22* | (2006.01) |

(52) U.S. Cl.

CPC ..... *E21B 34/025* (2020.05); *E21B 47/06* (2013.01); *E21B 19/22* (2013.01)

(58) Field of Classification Search

CPC ..... E21B 34/025; E21B 47/06

See application file for complete search history.

(56) References Cited

U.S. PATENT DOCUMENTS

| | | | | |
|---|---|---|---|---|
| 6,347,675 | B1 * | 2/2002 | Kolle | E21B 21/16 175/69 |
| 9,797,223 | B1 * | 10/2017 | Gordon | E21B 41/0007 |
| 12,078,041 | B1 * | 9/2024 | Fardan | E21B 43/38 |
| 2004/0065440 | A1 | 4/2004 | Farabee | |
| 2013/0092395 | A1 | 4/2013 | Hudson | |
| 2017/0370213 | A1 | 12/2017 | Knight | |
| 2020/0270953 | A1 | 8/2020 | Ziegler | |
| 2022/0010641 | A1 | 1/2022 | Haugland | |
| 2023/0080453 | A1 * | 3/2023 | Idris | E21B 47/06 166/250.01 |

OTHER PUBLICATIONS

Search Report and Written Opinion of International Patent Application No. PCT/US2024/031224 dated Sep. 3, 2024, 12 Pages.

* cited by examiner

*Primary Examiner* — Catherine Loikith
(74) *Attorney, Agent, or Firm* — Jeffrey D. Frantz

(57) ABSTRACT

A sour production fluid mitigation system may be at an entry point below an injection sub for a coiled tubing system, pumping an inhibited fluid through pressure control equipment for the coiled tubing system to an exit point. A sour production fluid mitigation system may use a choke guide below the exit point and above a wellhead, maintaining an inhibited fluid pressure at the exit point greater than or equal to a production fluid pressure at a production tree of the wellhead.

18 Claims, 6 Drawing Sheets

WELL PRODUCTION MANAGEMENT IN SOUR ENVIRONMENT AT A SURFACE EQUIPMENT ZONE

CROSS-REFERENCE TO RELATED APPLICATIONS

The present application is the National Stage Entry of International Application No. PCT/US2024/031224, filed May 28, 2024, which claims priority to and the benefit of U.S. Provisional Patent Application Ser. No. 63/504,474 titled "WELL PRODUCTION MANAGEMENT IN SOUR ENVIRONMENT AT A SURFACE EQUIPMENT ZONE" filed May 26, 2023, the disclosure of which is incorporated herein by reference in its entirety.

BACKGROUND

Exploring, drilling, and completing hydrocarbon and other wells are generally complicated, time consuming and ultimately very expensive endeavors. As such, tremendous emphasis is often placed on well applications and monitoring that rely heavily on periodic intervention for sake of well management. For example, various wireline, tractoring, coiled tubing (CT) and other types of interventions are often periodically introduced to the well throughout a life of the well. These interventions may be aimed at acquiring well condition information, directing a well cleanout, installation of downhole devices or a variety of other applications.

By way of example, CT supported applications utilize an injector positioned over pressure control equipment (PCE) that may include a head with pressure control valves, chokes and other features that is secured to a blowout preventor (BOP) stack at a well head leading to the well below surface. In certain circumstances the production flow from the well and through this equipment may be particularly sour and/or corrosive to the equipment during the intervention. For example, in many oilfields, wells are prone to produce high levels of hydrogen sulfide ($H_2S$) that is often over about 10% of the production flow.

Unfortunately, once hydrogen sulfide reaches or exceeds such levels, the effect on the surface equipment may be damaging to the equipment. The PCE over the BOP is often most susceptible to this type of damage, although other equipment may be damaged by this high $H_2S$ content production flow as well. Indeed, it would not be uncommon for the pressure control equipment to begin to fail after a period, generally in advance of the other equipment. Regardless, the end result may be a largely uncontrolled production flow through all of the equipment risking further failure and a potentially catastrophic event. Therefore, once failure of the pressure control equipment is detected, operations at the well are generally shut down for sake of remedial action which may include repair or replacement of damaged equipment.

Such a shutdown may avoid a catastrophic event. However, this shut down comes at a very high cost and may not always be possible, should the BOP also be damaged. Not only does the equipment require repair or replacement, but the shutdown itself may cost operators an increased amount of labor and the downtime may last for days. This is without counting any harm to the environment and people, which such a release could generate. As a result, the overall damage incurred by the production of the sour producing fluids through the equipment may reach costs in the millions of dollars.

Efforts to avoid these issues have been undertaken, particularly in the area of CT interventions where the CT itself is also prone to failure over the course of an application. For example, application times may be limited, and the CT may be coated with an $H_2S$ corrosion inhibitor, enhanced monitoring employed and the use of inhibitor slugs through the CT may also be employed. These efforts may be sufficient in certain circumstances. However, where the $H_2S$ content of the production flow exceeds about 10%, these techniques may not be enough to avoid shutdown. Whether due to acid level, low well pressure, depletion or a variety of other factors, additional measures may be warranted.

SUMMARY

In some aspects, the techniques described herein relate to a method of managing sour fluid at a surface equipment zone. A sour production fluid mitigation system, at an entry point below an injection sub for a coiled tubing system, pumps an inhibited fluid through pressure control equipment for the coiled tubing system to an exit point. The sour production fluid mitigation system, a choke guide below the exit point and above a wellhead, maintains an inhibited fluid pressure at the exit point greater than or equal to a production fluid pressure at a production tree of the wellhead.

In some aspects, the techniques described herein relate to a method of managing sour fluid at a surface equipment zone. A sour production fluid mitigation system measures a production fluid pressure at a production tree of a wellhead. The sour production fluid mitigation system measures an inhibited fluid pressure at an exit point of the wellhead. The exit point is located between pressure control equipment and the production tree. When a differential pressure between the inhibited fluid pressure and the production fluid pressure is below a low pressure threshold, the sour production fluid mitigation system flows an inhibited fluid with an inhibited flow rate from an entry point to the exit point. The entry point is located above the pressure control equipment and below an injection sub. Flowing the inhibited fluid increases the inhibited fluid pressure such that the differential pressure is equal to or greater than the low pressure threshold.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 1-2 is a representation of the coiled tubing system of FIG. 1-1.

FIG. 2-1 through FIG. 2-3 are cross-sectional representations of a choke guide ram, according to at least one embodiment of the present disclosure.

FIG. 3 is a flowchart of a method for mitigating sour fluid in a coiled tubing stack, according to at least one embodiment of the present disclosure.

DETAILED DESCRIPTION

The present disclosure outlines a novel and non-obvious architecture and techniques for management of sour and/or corrosive production fluids through surface equipment. The architecture and techniques are particularly adept at effectiveness where CT applications are in play and in the face of hydrogen sulfide production. However, a variety of interventional application types in the face of various other sour fluids production may take advantage of the architectures and techniques detailed herein.

In accordance with at least one embodiment of the present disclosure, a sour production fluid mitigation system may include a CT stack including a cross-flow inhibited fluid flow through the PCE. For example, the CT stack may include an entry point below a stripper for the CT system. An exit point may be located below the PCE of the CT system. For example, the PCE may be located between the entry point and the exit point. The entry point may be a tee or other connection point that may facilitate insertion and retrieval of a fluid in the CT stack. A production tree may be located below the exit point.

As discussed herein, during hydrocarbon production, the well may produce sour fluid, or corrosive fluid, such as fluid having a high hydrogen sulfide concentration (e.g., greater than 10%) and/or a high concentration of carbon dioxide ($CO_2$). The sour fluid may damage components of the CT system, including the stripper and/or the PCE. In accordance with at least one embodiment of the present disclosure, an inhibited fluid may be flowed through the CT stack between the entry point and the exit point. The inhibited fluid may be formed from a high pH (e.g., basic, over 7.0 pH) fluid and include one or more $H_2S$ and/or $CO_2$ inhibitors. Flowing the inhibited fluid through the CT stack may prevent or reduce damage or corrosion of the PCE, stripper, and other components of the CT stack.

The CT stack may further include a choke guide ram between the exit point and the production tree on the wellhead (e.g., below the exit point and above the production tree). The choke guide ram may include a choke ram that, when extended, may form a cylindrical choke, through which the tubing of the CT system may extend. The choke may restrict flow from the CT stack and the wellhead. This may increase the pressure differential between the exit point and the production tree. In some embodiments, the pressure at the exit point may be greater than the production tree. This may prevent ingress of the sour fluid from the well into the CT stack. Maintaining a high pressure differential between the exit point and the production tree, thereby reducing or preventing ingress of sour fluid into the CT stack, may reduce damage to the components of the CT stack, thereby extending its operating life.

Figure 1:
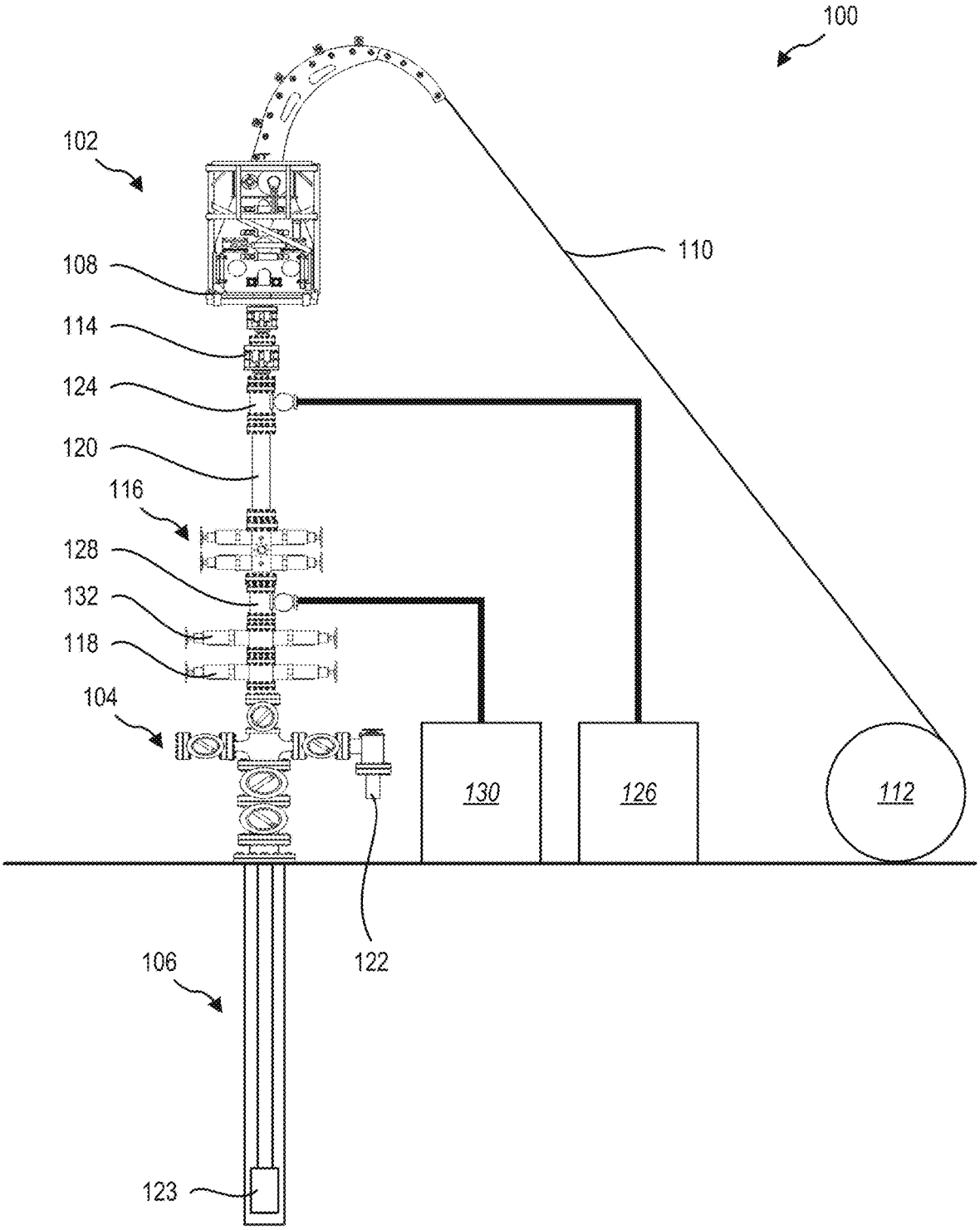
FIG. 1-1 is a representation of a sour production fluid mitigation system, according to at least one embodiment of the present disclosure.

FIG. 1-1 is a representation of a sour production fluid mitigation system 100 at a surface equipment zone, according to at least one embodiment of the present disclosure. The sour production fluid mitigation system 100 in the surface equipment zone may include a coiled tubing system 102 secured to a wellhead 104 connected to a well 106. The coiled tubing system 102 may perform an intervention in a well 106. To perform the intervention, an injection sub 108 may guide coiled tubing 110 from a coil 112 through the coiled tubing system 102.

The coiled tubing system 102 may include a stripper 114 below the injection sub 108 to contain and remove fluid from the intervention. Pressure control equipment 116 (PCE) is located below the stripper 114, with a safety head 118 located between the pressure control equipment 116 and the wellhead 104. A riser 120 may be located between the PCE 116 and the stripper 114 to raise the height of the connection between the injection sub 108 and the rest of the coiled tubing system 102. The safety head 118 may include one or more rams to shear the coiled tubing 110 in the coiled tubing system 102 and seal the coiled tubing system 102 from ingress of fluids from the well 106. The wellhead 104 may include a production valve 122. The production valve 122 may control and direct production fluid from the well 106 to storage, transportation, and/or processing.

During an intervention, the coiled tubing 110 may be inserted into the well 106. A CT bottom hole assembly (BHA) 123 may include one or more downhole tools to perform a particular task. Tasks performed during an intervention may include, but are not limited to, well conditioning, well cleaning, well stimulation, water or gas conformance, fracking, casing perforation, surveying and other condition monitoring, tool retrieval, and combinations thereof.

In accordance with at least one embodiment of the present disclosure, the sour production fluid mitigation system 100 flows an inhibited fluid (e.g., an inhibited brine, a sweet fluid) through the coiled tubing system 102 from an upper portion of the coiled tubing system 102 to a lower portion of the coiled tubing system 102. This may reduce or prevent ingress of production fluid and other fluids from the well 106 into the coiled tubing system 102, thereby reducing or preventing corrosion of components of the coiled tubing system 102, including the corrosion of the well 106 and/or the stripper 114.

To flow the inhibited fluid through the coiled tubing system 102, the inhibited fluid may be inserted into the coiled tubing system 102 at an entry point 124. For example, the inhibited fluid may be pumped, using an inhibited fluid pump, from an inhibited fluid tank 126 to the entry point 124. The inhibited fluid pump may be in fluid communication with the entry point 124. The entry point 124 may include a flow-tee installed in coiled tubing system 102. The entry point 124 may be installed between the stripper 114 and the riser 120. In some embodiments, the entry point 124 may be installed below the riser 120.

The inhibited fluid pump may pump the inhibited fluid through the coiled tubing system 102 to an exit point 128. At least a portion of the inhibited fluid (and any other fluid in the coiled tubing system 102, or fluid in the annular space between the coiled tubing 110 and the inner walls of the components of the coiled tubing system 102) may pass out of the coiled tubing system 102 at the exit point 128. The inhibited fluid passed out of the coiled tubing system 102 at the exit point 128 may be collected at a collection and analysis tank 130. As discussed herein, the collected inhibited fluid in the collection and analysis tank 130 may be analyzed for the presence of corrosive components, such as $H_2S$ and $CO_2$. The collected inhibited fluid may then be disposed or used in another process.

In accordance with at least one embodiment of the present disclosure, the coiled tubing system 102 may include a choke ram guide 132. The choke ram guide 132 may include a reduction in the annular space between the coiled tubing 110 and the inner walls of the choke. This may restrict the amount of fluid that may pass between the coiled tubing system 102 and the well 106. For example, the restriction at the choke ram guide 132 may increase the pressure differential between the exit point 128 and the production valve 122. When the pressure at the exit point 128 is greater than the pressure at the production valve 122, fluids from the well 106 may pass out of the production valve 122 and may not pass through the choke ram guide 132 into the coiled tubing system 102. As discussed herein, fluids from the well 106 may be sour, or may include corrosive or otherwise harmful components that may result in damage to the elements of the coiled tubing system 102. Raising the pressure at the choke ram guide 132 may reduce or prevent ingress of sour fluids from the well 106, thereby reducing or preventing damage of the coiled tubing system 102 from sour fluids.

Figures 1, 2:
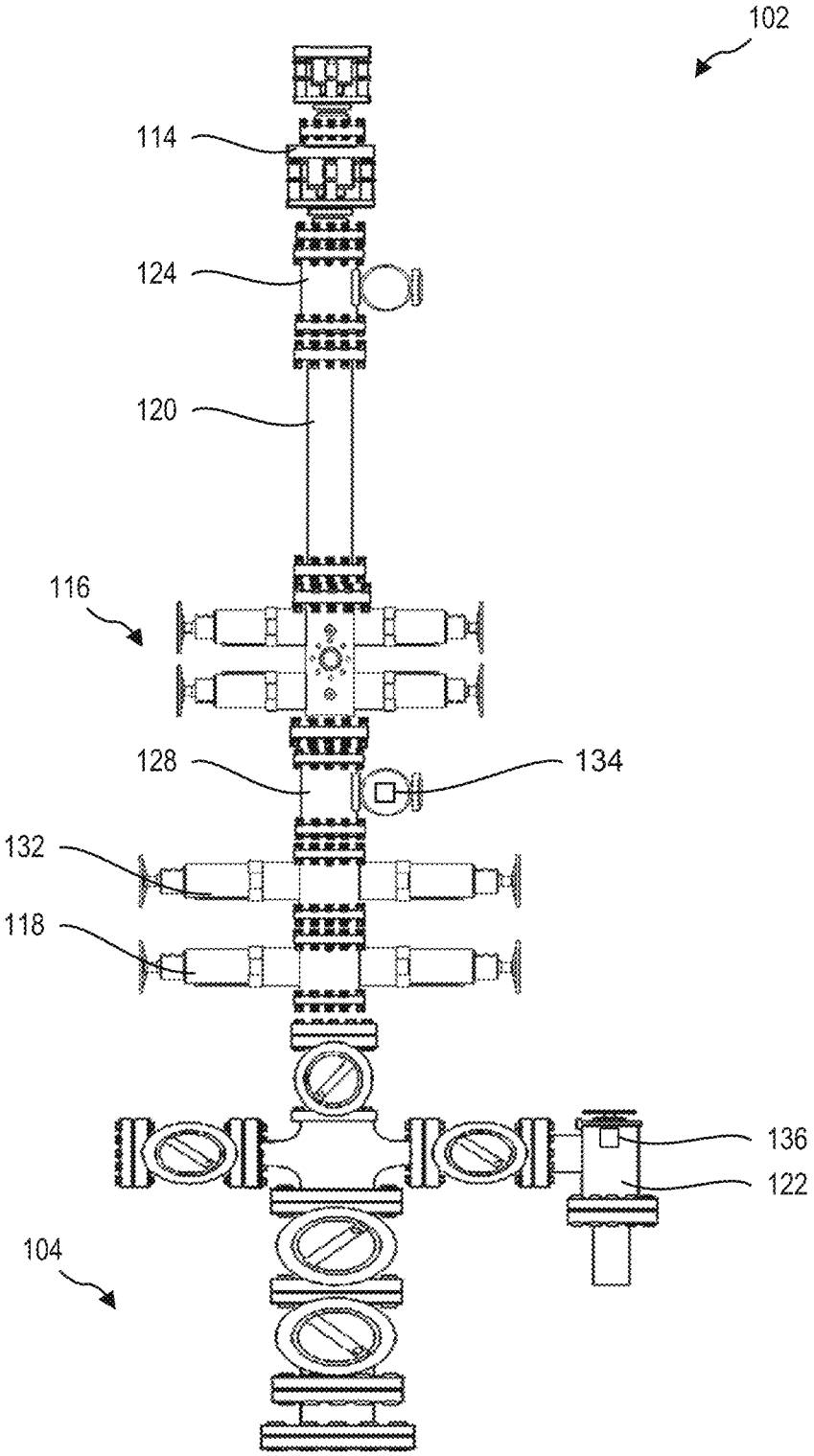

FIG. 1-2 is a representation of the coiled tubing system 102 of FIG. 1-1. As discussed herein, an inhibited fluid may be pumped into the coiled tubing system 102 at the entry point 124 and out of the coiled tubing system 102 at the exit point 128. The choke ram guide 132 may constrict the annular space inside the coiled tubing system 102 to increase the pressure between the exit point 128 and the production valve 122.

In accordance with at least one embodiment of the present disclosure, the coiled tubing system 102 may include an exit pressure sensor 134 at the exit point 128 and a production pressure sensor 136 at the wellhead 104. For example, the production pressure sensor 136 may be located at the production valve 122. The exit pressure sensor 134 may measure the inhibited fluid pressure (e.g., P1) of the fluid flow through the exit point 128. The production pressure sensor 136 may measure the production fluid pressure (e.g., P2) of the fluid flow through the production valve 122. The exit pressure sensor 134 and the production pressure sensor 136 may measure their respective pressures with respect to any frame of reference, such as the atmospheric pressure (e.g., gauge pressure) or a vacuum (e.g., absolute pressure). A pressure differential may be the difference in pressure between the inhibited fluid pressure and the production fluid pressure (e.g., the inhibited fluid pressure minus the production fluid pressure, P1-P2).

In some embodiments, the inhibited flow rate may be in a range having an upper value, a lower value, or upper and lower values including any of 1 gallon per minute (gpm) (0.23 cubic meters per hour (cmh)), 5 gpm (1.14 cmh), 10 gpm (2.27 cmh), 15 gpm (3.41 cmh), 20 gpm (4.54 cmh), 30 gpm (6.81 cmh), 40 gpm (9.08 cmh), 50 gpm (11.4 cmh), 75 gpm (17.0 cmh), 100 gpm (22.7 cmh), 250 gpm (56.8 cmh), 500 gpm (114 cmh), or any value therebetween. For example, the inhibited flow rate may be greater than 1 gpm (0.23 cmh). In another example, the inhibited flow rate may be less than 500 gpm (114 cmh). In yet other examples, the inhibited flow rate may be any value in a range between 1 gpm (0.23 cmh) and 500 gpm (114 cmh). In some embodiments, it may be critical that the inhibited flow rate is between approximately 10 gpm (2.27 cmh) and approximately 50 gpm (11.4 cmh) to prevent ingress of the sour fluid into the coiled tubing system 102.

As discussed herein, the choke ram guide 132 may increase the inhibited fluid pressure. The inhibited fluid pressure may change based on an inhibited flow rate of the inhibited fluid between the entry point 124 and the inhibited fluid tank 126. For example, a higher inhibited flow rate may increase the inhibited fluid pressure and a lower inhibited flow rate may decrease the inhibited fluid pressure.

In some embodiments, the inhibited fluid pressure may be in a range having an upper value, a lower value, or upper and lower values including any of 100 psi (0.69 MPa), 250 psi (1.72 MPa), 500 psi (3.45 MPa), 1,000 psi (6.89 MPa), 1,500 psi (10.3 MPa), 2,000 psi (13.8 MPa), 2,500 psi (17.2 MPa), 3,000 psi (20.7 MPa), 3,500 psi (24.1 MPa), 4,000 psi (27.6 MPa), or any value therebetween. For example, the inhibited fluid pressure may be greater than 100 psi (0.69 MPa). In another example, the inhibited fluid pressure may be less than 4,000 psi (27.6 MPa). In yet other examples, the inhibited fluid pressure may be any value in a range between 100 psi (0.69 MPa) and 4,000 psi (27.6 MPa). In some embodiments, it may be critical that the inhibited fluid pressure is between approximately 1,000 PSI (6.89 MPa) and approximately 3,000 psi (20.7 MPa) to maintain the inhibited fluid pressure higher than the production pressure.

In some embodiments, the production fluid pressure may be in a range having an upper value, a lower value, or upper and lower values including any of 100 psi (0.69 MPa), 250 psi (1.72 MPa), 500 psi (3.45 MPa), 1,000 psi (6.89 MPa), 1,500 psi (10.3 MPa), 2,000 psi (13.8 MPa), 2,500 psi (17.2 MPa), 3,000 psi (20.7 MPa), 3,500 psi (24.1 MPa), 4,000 psi (27.6 MPa), or any value therebetween. For example, the production fluid pressure may be greater than 100 psi (0.69 MPa). In another example, the production fluid pressure may be less than 4,000 psi (27.6 MPa). In yet other examples, the production fluid pressure may be any value in a range between 100 psi (0.69 MPa) and 4,000 psi (27.6 MPa). In some embodiments, it may be critical that the production fluid pressure is between approximately 1,000 PSI (6.89 MPa) and approximately 3,000 psi (20.7 MPa) to maintain the inhibited fluid pressure higher than the production pressure.

As discussed herein, a positive pressure differential between the inhibited fluid pressure and the production fluid pressure (e.g., inhibited fluid pressure minus production fluid pressure, P1 minus P2) may reduce or prevent the inflow of production fluids from the well, including sour or corrosive fluids. In some embodiments, the pressure differential may be in a range having an upper value, a lower value, or upper and lower values including any of 10 psi (68.9 kPa), 20 psi (138 kPa), 30 psi (207 kPa), 40 psi (276 kPa), 50 psi (345 kPa), 60 psi (414 kPa), 70 psi (483 kPa), 80 psi (552 kPa), 90 psi (621 kPa), 100 psi (689 kPa), 125 psi (862 kPa), 150 psi (1,034 kPa), 200 psi (1,379 kPa), or any value therebetween. For example, the pressure differential may be greater than 10 psi (68.9 kPa). In another example, the pressure differential may be less than 200 psi (1,379 kPa). In yet other examples, the pressure differential may be any value in a range between 10 psi (68.9 kPa) and 200 psi (1,379 kPa). In some embodiments, it may be critical that the pressure differential is between approximately 50 psi (345 kPa) and approximately 100 psi (689 kPa) to prevent the ingress of production fluids into the coiled tubing system 102 while limiting the loss of the inhibited fluid into the well.

In some embodiments, the sour production fluid mitigation system 100 may monitor the pressure differential. For example, the sour production fluid mitigation system 100 may monitor the inhibited fluid pressure as measured by the exit pressure sensor 134 and the production fluid pressure as measured by the production pressure sensor 136, and calculate the difference between the inhibited fluid pressure and the production fluid pressure. When the pressure differential is outside of a pressure threshold range (e.g., between a low pressure threshold and a high pressure threshold), the sour production fluid mitigation system 100 may adjust the inhibited flow rate. For example, when the pressure differential is less than a low pressure threshold, the sour production fluid mitigation system 100 may increase the inhibited flow rate, thereby increasing the inhibited fluid pressure and the differential pressure. In some examples, when the pressure differential is greater than a high pressure threshold, the sour production fluid mitigation system 100 may decrease the inhibited flow rate, thereby decreasing the inhibited fluid pressure and the differential pressure.

In some embodiments, the low pressure threshold may be in a range having an upper value, a lower value, or upper and lower values including any of 10 psi (68.9 kPa), 20 psi (138 kPa), 30 psi (207 kPa), 40 psi (276 kPa), 50 psi (345 kPa), 60 psi (414 kPa), 70 psi (483 kPa), 80 psi (552 kPa), 90 psi (621 kPa), 100 psi (689 kPa), or any value therebetween. For example, the low pressure threshold may be greater than 10 psi (68.9 kPa). In another example, the low pressure threshold may be less than 100 psi (689 kPa). In yet other examples, the low pressure threshold may be any value in a range between 10 psi (68.9 kPa) and 100 psi (689 kPa). In some embodiments, it may be critical that the low pressure threshold is between approximately 30 psi (207 kPa) and approximately 60 psi (414 kPa) to prevent ingress of sour fluids into the coiled tubing system 102.

In some embodiments, the high pressure threshold may be in a range having an upper value, a lower value, or upper and lower values including any of 70 psi (483 kPa), 80 psi (552 kPa), 90 psi (621 kPa), 100 psi (689 kPa), 125 psi (862 kPa), 150 psi (1,034 kPa), 200 psi (1,379 kPa), or any value therebetween. For example, the high pressure threshold may be greater than 70 psi (483 kPa). In another example, the high pressure threshold may be less than 200 psi (1,379 kPa). In yet other examples, the high pressure threshold may be any value in a range between 70 psi (483 kPa) and 200 psi (1,379 kPa). In some embodiments, it may be critical that the high pressure threshold is between approximately 80 psi (552 kPa) and approximately 125 psi (862 kPa) to reduce the backflow of the inhibited fluid flow into the wellhead 104.

While implementing an intervention with the coiled tubing system 102, the production fluid pressure at the production valve 122 may change. For example, the intervention may include a perforation operation. The well may not be producing, or may be producing at a low rate, while tripping the CT into the well. After the perforation operation, the production volume, and therefore the production pressure at the production valve 122 may increase. As discussed herein, the sour production fluid mitigation system 100 may monitor the production fluid pressure. When the production fluid pressure increases, the differential pressure may decrease to below the low pressure threshold. In response, the sour production fluid mitigation system 100 may increase the inhibited flow rate, thereby raising the differential pressure. In some embodiments, the sour production fluid mitigation system 100 may pre-emptively increase the inhibited flow rate. For example, the sour production fluid mitigation system 100 may identify that the perforation operation may increase the production flow and decrease the differential pressure. Prior to or during the perforation operation, the sour production fluid mitigation system 100 may increase the flow rate to prevent an anticipated ingress of sour fluid into the coiled tubing system 102.

FIG. 2-1 is a representation of perspective cross-sectional view of a choke guide ram 232 in an open configuration, according to at least one embodiment of the present disclosure. The choke guide ram 232 includes a choke 238. The choke 238 may be split into a first choke section 240-1 and a second choke section 240-2. In the open configuration shown, the first choke section 240-1 and the second choke section 240-2 are separated. This may allow a larger-diameter section of a CT system to pass through the choke guide ram 232, such as a BHA (e.g., the BHA 123 of FIG. 1-1).

The choke guide ram 232 includes a first ram 242-1 and a second ram 242-2. The first ram 242-1 is connected to the first choke section 240-1 and the second ram 242-2 is connected to the second choke section 240-2. The first ram 242-1 and the second ram 242-2 may include hydraulic or pneumatic pistons. In the retracted position shown, the first ram 242-1 and the second ram 242-2 may pull the first choke section 240-1 and the second choke section 240-2 apart from each other, thereby increasing the inner diameter of the choke guide ram 232.

When the CT has passed through the choke guide ram 232, the first ram 242-1 and the second ram 242-2 may expand into the closed configuration illustrated in FIG. 2-2. In the closed configuration, the choke 238 may form a cylinder through which the CT may pass. The choke 238 may guide the CT through the coiled tubing system.

The choke 238 may be formed from any material. For example, the choke 238 may be formed from brass. Forming the choke 238 from brass may reduce the friction between the choke 238, reduce corrosion from sour drilling fluid, be non-sparking, and so forth. In this manner, the choke 238 may facilitate the operation of the coiled tubing system.

Figures 1, 2:
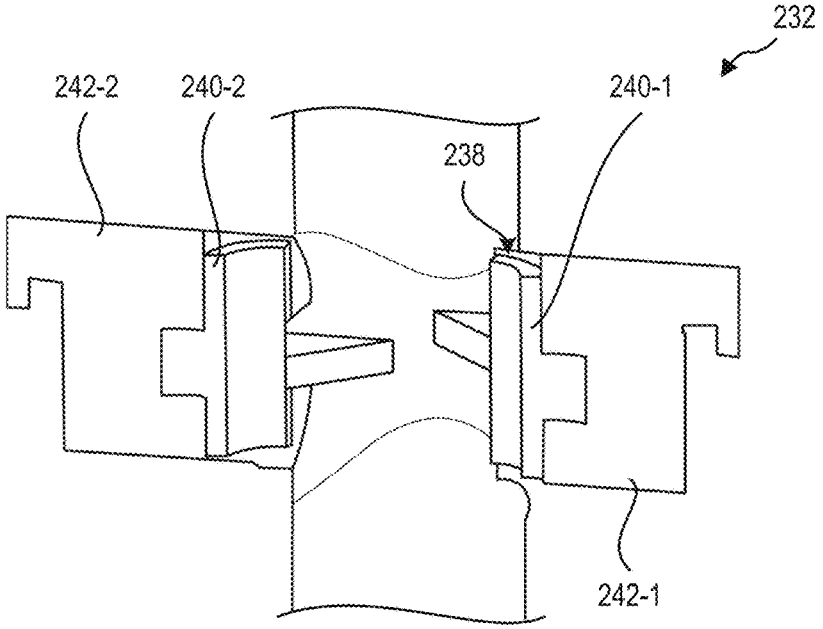
Figure 2:
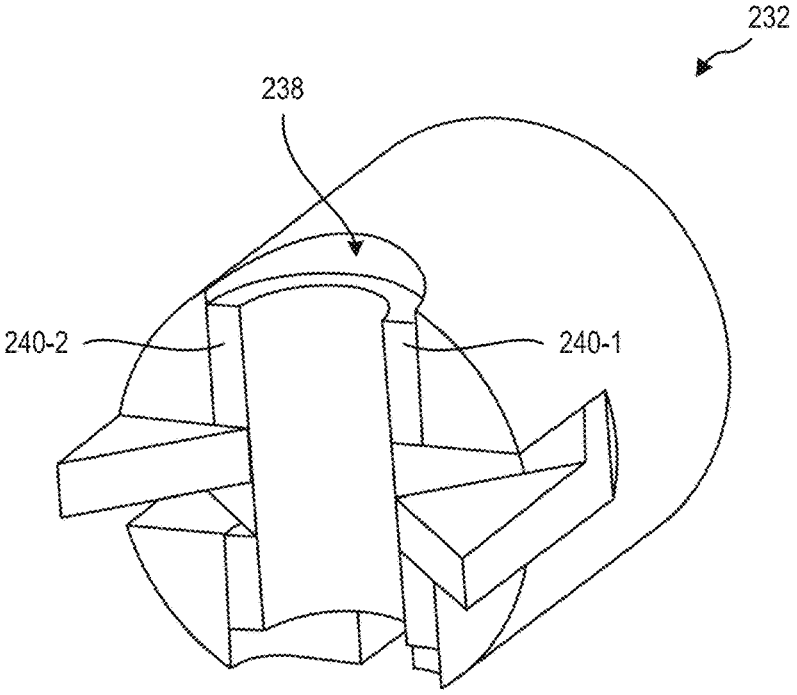
Figures 2, 3:
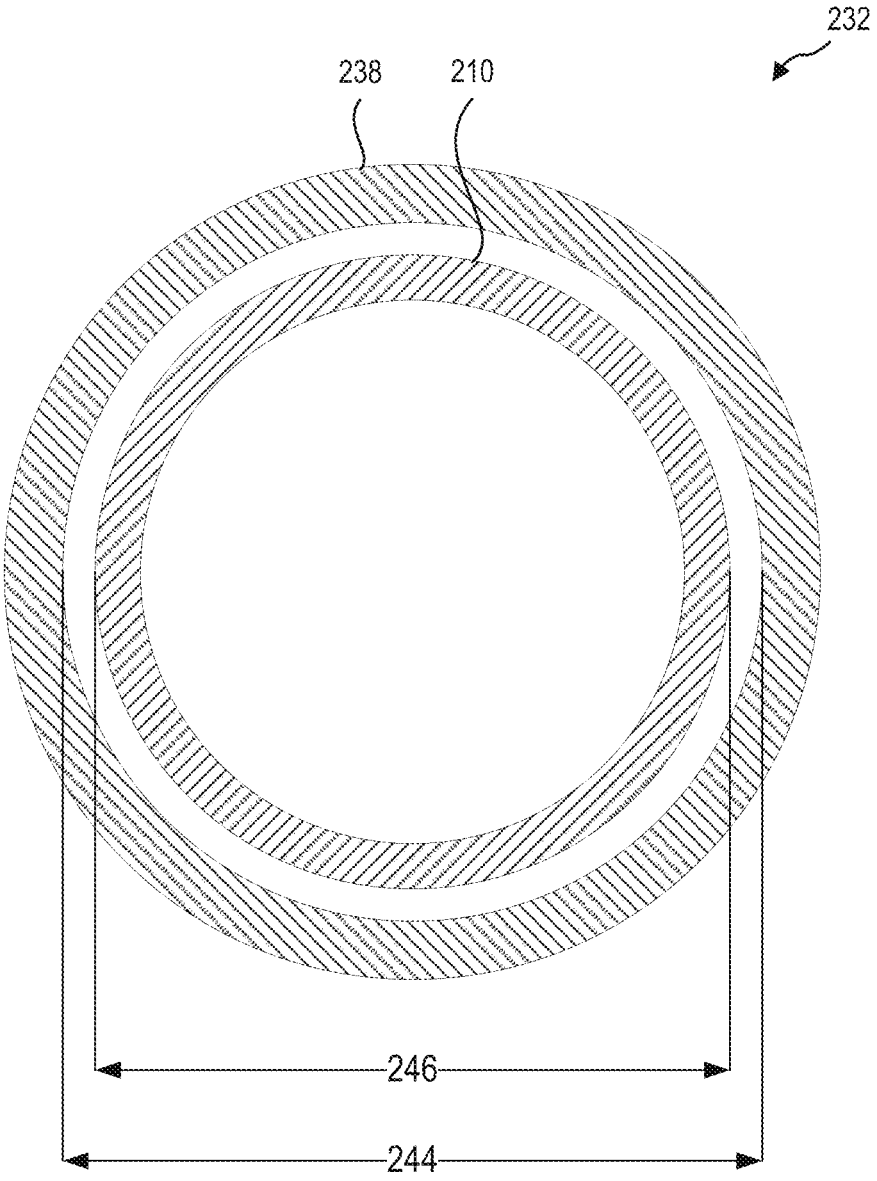
Figure 3:
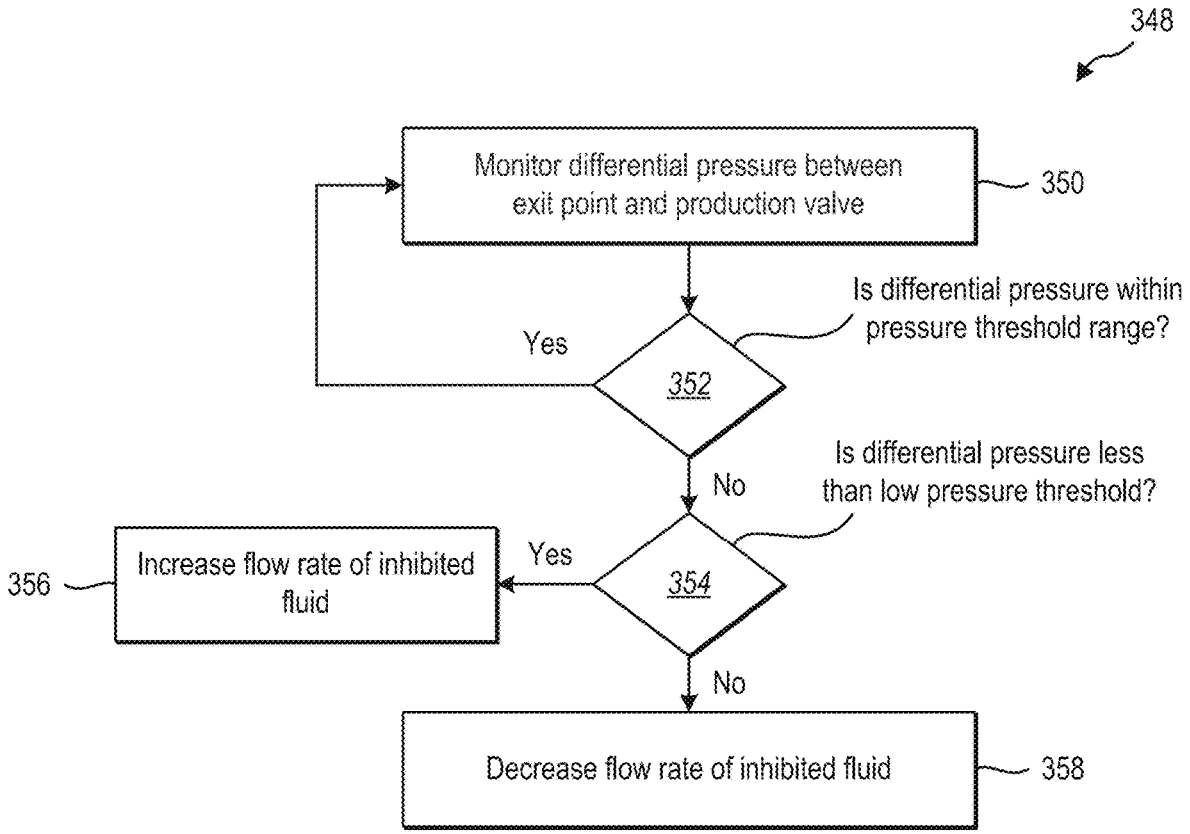

FIG. 2-3 is a cross-sectional representation of the choke guide ram 232 in the closed configuration of FIG. 2-2. The choke 238 has a choke diameter 244 that is larger an outer CT diameter 246 of CT 210. The difference between the choke diameter 244 and the outer CT diameter 246 is the annular gap between the choke 238 and the CT 210. As discussed herein, reducing the annular gap between the choke 238 and the CT 210 may increase the pressure of the inhibited fluid, including the inhibited pressure at the exit point 128. The inner diameter of the choke 238 may be sufficient for the CT to pass therethrough. The CT may have any CT diameter, including 1 in., 1.5 in., 1.75 in., 2.0 in., 2.25 in., 2.5 in., 3.0 in., or any value therebetween. The inner diameter of the choke 238 may be larger than the outer diameter of the CT by the annular gap.

In some embodiments, the annular gap may be in a range having an upper value, a lower value, or upper and lower values including any of 1/32 in. (0.79 mm), 1/16 in. (1.59 mm), 3/32 in. (2.38 mm), 1/8 in. (3.18 mm), 5/32 in. (3.97 mm), 3/16 in. (4.76 mm), 7/32 in. (5.56 mm), % in. (6.35 mm), 9/32 in. (7.14 mm), 5/16 in. (7.94 mm), 11/32 in. (8.73 mm), 3/8 in. (9.53 mm), or any value therebetween. For example, the annular gap may be greater than 1/32 in. (0.79 mm). In another example, the annular gap may be less than 3/8 in. (9.53 mm). In yet other examples, the annular gap may be any value in a range between 1/32 in. (0.79 mm) and 3/8 in. (9.53 mm). In some embodiments, it may be critical that the annular gap is between approximately 1/8 in. (3.18 mm) and approximately 3/16 in. (4.76 mm) to increase the inhibited fluid pressure at the exit point.

Figure 4:
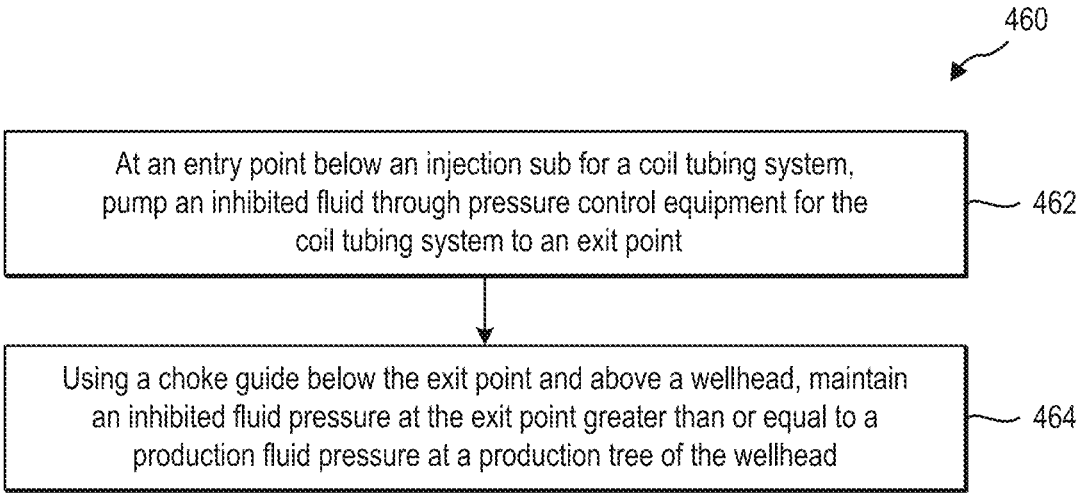
FIG. 4 is a flowchart of a method for mitigating sour fluid in a coiled tubing stack, according to at least one embodiment of the present disclosure.
Figure 5:
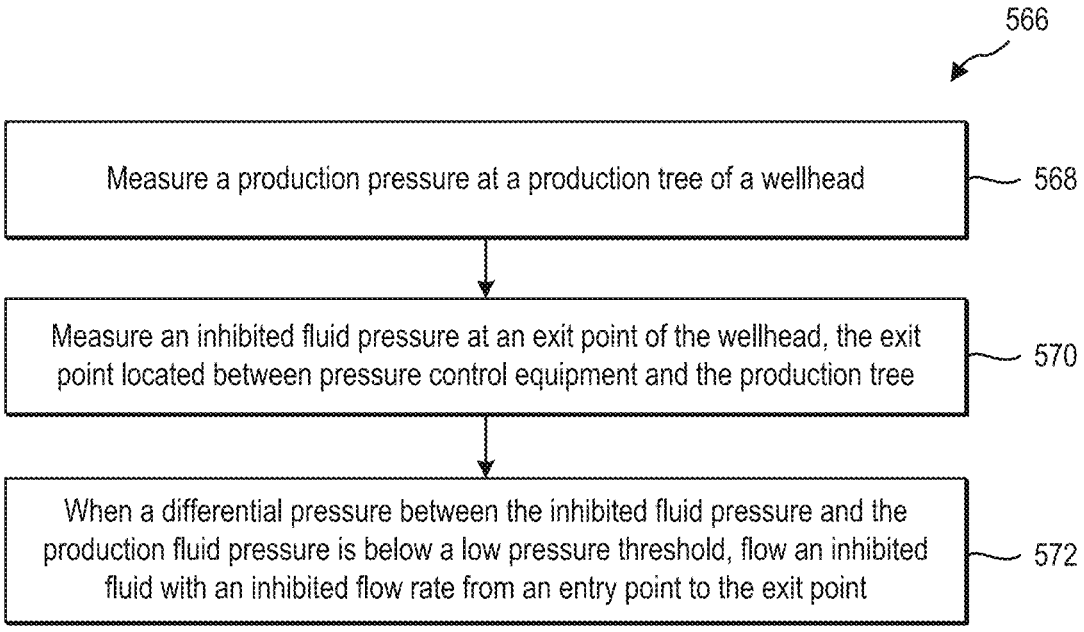
FIG. 5 is a flowchart of a method for mitigating sour fluid in a coiled tubing stack, according to at least one embodiment of the present disclosure.

FIG. 3 through FIG. 5, the corresponding text, and the examples provide a number of different methods, systems, devices, and computer-readable media of the sour production fluid mitigation system 100. In addition to the foregoing, one or more embodiments can also be described in terms of flowcharts comprising acts for accomplishing a particular result, as shown in FIG. 3 through FIG. 5. FIG. 3 through FIG. 5 may be performed with more or fewer acts. Further, the acts may be performed in differing orders. Additionally, the acts described herein may be repeated or performed in parallel with one another or parallel with different instances of the same or similar acts.

As mentioned, FIG. 3 illustrates a flowchart of a series of acts or a method 348 for managing mitigating sour fluid at a surface equipment zone during an intervention in a well, according to at least one embodiment of the present disclosure. While FIG. 3 illustrates acts according to one embodiment, alternative embodiments may omit, add to, reorder, and/or modify any of the acts shown in FIG. 3. The acts of FIG. 3 can be performed as part of a method. Alternatively, a computer-readable medium can comprise instructions that, when executed by one or more processors, cause a computing device to perform the acts of FIG. 3. In some embodiments, a system can perform the acts of FIG. 3.

The sour production fluid mitigation system may monitor a differential pressure between an exit point (e.g., the exit point 128 of FIG. 1-2) and a production valve (e.g., production valve 122 of FIG. 1-2) at 350. For example, the sour production fluid mitigation system may monitor the inhibited fluid pressure using a pressure sensor at the exit point and a production fluid pressure using a production pressure sensor at the production valve. The sour production fluid mitigation system may determine the differential pressure by subtracting the production fluid pressure from the inhibited fluid pressure.

The sour production fluid mitigation system may determine 352 whether the differential pressure is within a pressure threshold range. If the differential pressure is within the pressure threshold range, then the sour production fluid mitigation system may continue to monitor the pressure differential. If the differential pressure is not within the pressure threshold range, then the sour production fluid mitigation system may determine 354 whether the differential pressure is less than the low pressure threshold. If the pressure differential is less than the low pressure threshold, then the sour production fluid mitigation system may increase the inhibited flow rate of the inhibited fluid at 356. As discussed herein, increasing the inhibited flow rate may increase the pressure at the exit point If the differential pressure is not less than the low pressure threshold, then the sour production fluid mitigation system may decrease the inhibited flow rate of the inhibited fluid at 358. For example, if the differential pressure is outside of the pressure threshold range, and the differential pressure is not less than the low pressure threshold, then the differential pressure is greater than the high pressure threshold, and the sour production fluid mitigation system may decrease the inhibited flow rate to decrease the inhibited pressure at the exit point. As may be understood, the sour production fluid mitigation system may determine whether the differential pressure is greater than the high pressure threshold at 354.

In accordance with at least one embodiment of the present disclosure, the sour production fluid mitigation system may manage the sour environment at the surface equipment zone by maintaining the inhibited fluid pressure to be greater than or equal to the production fluid pressure at the production tree of the wellhead. For example, the sour production fluid mitigation system may use a choke guide below the exit point to increase the inhibited fluid pressure. The sour production fluid mitigation system may maintain the inhibited fluid pressure greater than or equal to the production fluid pressure by adjusting the inhibited fluid flow of the inhibited fluid. For example, the sour production fluid mitigation system may maintain the inhibited fluid pressure greater than or equal to the production fluid pressure by increasing the inhibited flow rate when the production fluid pressure at the production tree of the wellhead exceeds the inhibited fluid pressure.

While FIG. 3 illustrates and describes the method 348 with respect to determining the differential pressure based on a pressure threshold, it should be understood that the sour production fluid mitigation system may adjust the flow rate of the inhibited fluid based on the hydrogen sulfide concentration. For example, the sour production fluid mitigation system may, upon collecting the inhibited fluid, determine the hydrogen sulfide threshold. If the hydrogen sulfide concentration is above a concentration threshold in the inhibited fluid, the sour production fluid mitigation system may increase the inhibited flow rate through the PCE.

In some embodiments, the concentration threshold may be in a range having an upper value, a lower value, or upper and lower values including any of 1%, 2%, 3%, 4%, 5%, 6%, 7%, 8%, 9%, 10%, or any value therebetween. For example, the concentration threshold may be greater than 1%. In another example, the concentration threshold may be less than 10%. In yet other examples, the concentration threshold may be any value in a range between 1% and 10%. In some embodiments, it may be critical that the concentration threshold is between approximately 1% and approximately 3% to reduce the hydrogen sulfide concentration and reduce or prevent damage to the PCE.

As mentioned, FIG. 4 illustrates a flowchart of a series of acts or a method 460 for managing mitigating sour fluid at a surface equipment zone during an intervention in a well, according to at least one embodiment of the present disclosure. While FIG. 4 illustrates acts according to one embodiment, alternative embodiments may omit, add to, reorder, and/or modify any of the acts shown in FIG. 4. The acts of FIG. 4 can be performed as part of a method. Alternatively, a computer-readable medium can comprise instructions that, when executed by one or more processors, cause a computing device to perform the acts of FIG. 4. In some embodiments, a system can perform the acts of FIG. 4.

The sour production fluid mitigation system may, at an entry point below an injection sub for a CT system, pump an inhibited fluid through PCE for the CT system to an exit point, at 462. The sour production fluid mitigation system may, using a choke guide below the exit point and above a wellhead, maintain an inhibited fluid pressure at the exit point greater than or equal to a production fluid pressure at a production tree of the wellhead at 464.

As mentioned, FIG. 5 illustrates a flowchart of a series of acts or a method 566 for managing mitigating sour fluid at a surface equipment zone during an intervention in a well, according to at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method. Alternatively, a computer-readable medium can comprise instructions that, when executed by one or more processors, cause a computing device to perform the acts of FIG. 5. In some embodiments, a system can perform the acts of FIG. 5.

The sour production fluid mitigation system may measure a production fluid pressure at a production tree of a wellhead at 568. The sour production fluid mitigation system may measure an inhibited fluid pressure at an exit point of the wellhead at 570. The exit point is located between PCE and the production tree. When a differential pressure between the inhibited fluid pressure and the production fluid pressure is below a low pressure threshold, the sour production fluid mitigation system may flow an inhibited fluid with an inhibited flow rate from an entry point to the exit point at 572. As discussed herein, the entry point is located above the PCE and below an injection sub. In some embodiments, flowing the inhibited fluid increases the inhibited fluid pressure such that the differential pressure is equal to or greater than the low pressure threshold.

INDUSTRIAL APPLICABILITY

As discussed herein, the proposed engineered wellhead stack relies on the continuous circulation of protective fluid (i.e.: inhibited brine) across the CT PCE, for preventing or minimizing the contact of reservoir fluids with the CT BOP, risers, and strippers. The entry point of the inhibited fluid is a flow-tee installed between the chemical injection sub and the risers.

The exit point of the inhibited fluid is a secondary flow-tee installed below the CT BOP. The continuous supply of inhibited fluid is conducted by a dedicated pumping injection system. The fluids coming from the exit point go through a testing unit equipped with adjustable choke and sample points that allows monitoring rates, $H_2S$ content, partial pressure, and pH. The pressure at the exit point (P1) should generally be slightly higher (100-50 psi) than the pressure at the production tree (P2), to minimize migration of producing fluids into the CT PCE.

Having a P1>P2 scenario is aimed by creating an adjustable flow restriction between the exit point and the production tree. This adjustable flow restriction is provided by an in-line choke device that allows the pass of CT tools and is protected by cladding or other, as it will have higher exposure to the reservoir fluids. Right below the in-line choke and just above the production tree will be a safety head or equivalent, which consists of a single shear/blind ram with capacity to shear CT string and CT tools. This component also should be protected by cladding or other, as will be exposed to the producing fluids.

The preceding description has been presented with reference to present embodiments. Persons skilled in the art and technology to which this disclosure pertains will appreciate that alterations and changes in the described structures and methods of operation can be practiced without meaningfully departing from the principle, and scope of this present disclosure. Accordingly, the foregoing description should not be read as pertaining only to the precise structures described and shown in the accompanying drawings, but rather should be read as consistent with and as support for the following claims, which are to have their fullest and fairest scope.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of managing sour fluid at a surface equipment zone, the method comprising:

at an entry point below an injection sub for a coiled tubing system, pumping an inhibited fluid through pressure control equipment for the coiled tubing system to an exit point; [and] using a choke guide below the exit point and above a wellhead, maintaining an inhibited fluid pressure at the exit point greater than or equal to a production fluid pressure at a production tree of the wellhead;

collecting the inhibited fluid from the exit point;

analyzing the inhibited fluid to identify a hydrogen sulfide concentration; and when the hydrogen sulfide concentration is above a concentration threshold, increasing an inhibited flow rate of the inhibited fluid through the pressure control equipment.

2. The method of claim 1, wherein pumping the inhibited fluid includes pumping the inhibited fluid against a production flow of production fluids to the wellhead.

3. The method of claim 1, wherein maintaining the inhibited fluid pressure includes adjusting an inhibited flow rate of the inhibited fluid through the pressure control equipment.

4. The method of claim 1, wherein maintaining the inhibited fluid pressure includes maintaining a pressure differential between the inhibited fluid pressure and the production fluid pressure within a pressure threshold range.

5. The method of claim 4, wherein the pressure threshold range is between 50 psi and 100 psi.

6. A method of managing sour fluid at a surface equipment zone, the method comprising:

measuring a production fluid pressure at a production tree of a wellhead;

measuring an inhibited fluid pressure at an exit point of the wellhead, the exit point located between pressure control equipment and the production tree; and when a differential pressure between the inhibited fluid pressure and the production fluid pressure is below a low pressure threshold, flowing an inhibited fluid with an inhibited flow rate from an entry point to the exit point, the entry point located above the pressure control equipment and below an injection sub, wherein flowing the inhibited fluid increases the inhibited fluid pressure such that the differential pressure is equal to or greater than the low pressure threshold.

7. The method of claim 6, further comprising:

collecting the inhibited fluid from the exit point; and analyzing the inhibited fluid to identify a hydrogen sulfide concentration.

8. The method of claim 7, further comprising, when the hydrogen sulfide concentration is above a concentration threshold, increasing the inhibited flow rate of the inhibited fluid between the entry point and the exit point.

9. The method of claim 6, further comprising, when the differential pressure is greater than a high pressure threshold, reducing the inhibited flow rate of the inhibited fluid between the entry point and the exit point.

10. The method of claim 9, wherein the high pressure threshold is approximately 100 psi.

11. The method of claim 6, wherein flowing the inhibited fluid includes flowing the inhibited fluid with a second flow rate, and further comprising flowing the inhibited fluid with a first flow rate while measuring the production fluid pressure and the inhibited fluid pressure, and wherein flowing the inhibited fluid includes increasing the inhibited flow rate from the first flow rate to the second flow rate.

12. The method of claim 6, wherein the low pressure threshold is approximately 50 psi.

13. A wellhead stack for a coiled tubing system, the wellhead stack comprising:

an entry point for insertion of an inhibited fluid;

an exit point below the entry point for collection of the inhibited fluid; and a choke guide ram below the exit point, the choke guide ram including a choke ram having an inner diameter to pass coiled tubing of the coiled tubing system to therethrough, the choke guide ram configured to increase an inhibited fluid pressure of the inhibited fluid between the entry point and the exit point when the coiled tubing is within the choke ram.

14. The wellhead stack of claim 13, further comprising pressure control equipment between the entry point and the exit point.

15. The wellhead stack of claim 13, further comprising a stripper above the entry point.

16. The wellhead stack of claim 13, further comprising an injection sub above the entry point.

17. The wellhead stack of claim 13, further comprising:

a production tree below the choke guide ram;

an exit pressure sensor at the exit point to measure an inhibited fluid pressure; and a production pressure sensor at the production tree to measure a production pressure.

18. The wellhead stack of claim 13, further comprising an inhibited fluid pump in fluid communication with the entry point to pump the inhibited fluid between the entry point and the exit point.

* * * * *